US007726620B1

(12) United States Patent
Kleespie

(10) Patent No.: US 7,726,620 B1
(45) Date of Patent: Jun. 1, 2010

(54) VERTICAL FUEL TANK SUPPORT SYSTEM

(76) Inventor: Bruce Kleespie, P.O. Box 95, Portage, WI (US) 53901

( * ) Notice: Subject to any disclaimer, the term of this patent is extended or adjusted under 35 U.S.C. 154(b) by 155 days.

(21) Appl. No.: 12/034,678

(22) Filed: Feb. 21, 2008

(51) Int. Cl.
*A47B 91/00* (2006.01)

(52) U.S. Cl. ..... 248/346.01; 248/903; 248/311.2; 248/146; 220/571; 220/572

(58) Field of Classification Search ..... 248/346.01, 248/346.02, 346.5, 903, 311.2, 346.03, 146, 248/523, 116; 52/27, 98, 99, 299, 169.9; 220/571, 572
See application file for complete search history.

(56) References Cited

U.S. PATENT DOCUMENTS

| | | | | | |
|---|---|---|---|---|---|
| 1,525,242 | A * | 2/1925 | Jagschitz | ..... | 52/126.7 |
| 3,735,895 | A * | 5/1973 | Roper | ..... | 220/565 |
| 4,393,999 | A * | 7/1983 | Forshee | ..... | 248/346.02 |
| 4,489,846 | A * | 12/1984 | Nickel | ..... | 220/632 |
| 4,932,621 | A * | 6/1990 | Kowk | ..... | 248/146 |
| 4,998,696 | A * | 3/1991 | Desjardins | ..... | 248/146 |
| 5,368,263 | A * | 11/1994 | Harrison | ..... | 248/146 |
| 5,836,554 | A * | 11/1998 | Lesage | ..... | 248/152 |
| 6,135,410 | A * | 10/2000 | Harrison | ..... | 248/346.01 |
| 6,216,990 | B1 * | 4/2001 | Harrison | ..... | 248/146 |
| 2007/0187564 | A1 * | 8/2007 | McGuire | ..... | 248/346.5 |
| 2009/0090835 | A1 * | 4/2009 | Harrison | ..... | 248/346.03 |

OTHER PUBLICATIONS

WB Sales, Inc., "Dandi Block", <retrieved from http://www.wbsales.net/dandi/dandi.asp Feb. 8, 2008>. Date of first publication is believed to be prior to Feb. 1, 2007.

* cited by examiner

*Primary Examiner*—Kimberly T Wood
(74) *Attorney, Agent, or Firm*—Neustel Law Offices

(57) ABSTRACT

A vertical fuel tank support system for efficiently supporting a vertical propane tank above the ground. The vertical fuel tank support system generally includes a support pad including an internal cavity, wherein the internal cavity extends throughout the support pad, an inner platform defining a first portion of an upper surface of the elongated support pad, wherein the inner platform is comprised of circular configuration, an outer platform defining a second portion of an upper surface of the elongated support pad, wherein the outer platform is comprised of circular configuration and an internal ribbing structure extending within the internal cavity and beneath the inner platform and the outer platform. The internal ribbing structure includes a first ribbing portion and a second ribbing portion, wherein the first ribbing portion interconnects with the second ribbing portion. The first ribbing portion extends across the inner platform and the outer platform and wherein the second ribbing portion extends solely around the outer platform.

20 Claims, 8 Drawing Sheets

VERTICAL FUEL TANK SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to propane tank supports and more specifically it relates to a vertical fuel tank support system for efficiently supporting a vertical propane tank above the ground.

2. Description of the Related Art

Any discussion of the related art throughout the specification should in no way be considered as an admission that such related art is widely known or forms part of common general knowledge in the field.

Propane tank supports have been in use for years and are generally utilized to support a propane tank above the ground. Propane tanks are supported above the ground for various reasons, such as to allow the propane tank to be painted, to allow maintenance upon the tank or to simply support the tank above the ground and prevent the tank from sinking within the ground or damaging the ground below.

Generally, concrete blocks are utilized to support the legs of a propane tank to support the tank above the ground. However, concrete blocks can be difficult to utilize for various reasons, such as but not limited to difficulty in moving around because of their weight, cumbersome to carry and fragile in that the concrete blocks may often crack if dropped upon a hard surface.

The prior art has also included preformed supports for propane tanks. However, these preformed supports generally do not include an efficient internal support structure to distribute weight in an efficient manner according to the positioning of the propane tank upon the support. Because of the inherent problems with the related art, there is a need for a new and improved propane tank support system for efficiently supporting a propane tank above the ground. Because of the inherent problems with the related art, there is a need for a new and improved vertical fuel tank support system for efficiently supporting a vertical propane tank above the ground.

BRIEF SUMMARY OF THE INVENTION

The general purpose of the present invention is to provide a vertical fuel tank support system that has many of the advantages of the propane tank supports mentioned heretofore. The invention generally relates to a propane tank support which includes a support pad including an internal cavity, wherein the internal cavity extends throughout the support pad, an inner platform defining a first portion of an upper surface of the elongated support pad, wherein the inner platform is comprised of circular configuration, an outer platform defining a second portion of an upper surface of the elongated support pad, wherein the outer platform is comprised of circular configuration and an internal ribbing structure extending within the internal cavity and beneath the inner platform and the outer platform. The internal ribbing structure includes a first ribbing portion and a second ribbing portion, wherein the first ribbing portion interconnects with the second ribbing portion. The first ribbing portion extends across the inner platform and the outer platform and wherein the second ribbing portion extends solely around the outer platform.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a vertical fuel tank support system for efficiently supporting a vertical propane tank above the ground.

Another object is to provide a propane tank support system that is lightweight and easy to maneuver.

An additional object is to provide a propane tank support system that may be manufactured to accommodate various size propane tanks (e.g. 20 gallon, 420 gallon, etc.).

A further object is to provide a propane tank support system that includes an internal ribbing structure to efficiently distribute the weight of the propane tank.

A further object is to provide a propane tank support system that includes drainage holes to prevent water from "sitting" upon the present invention.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
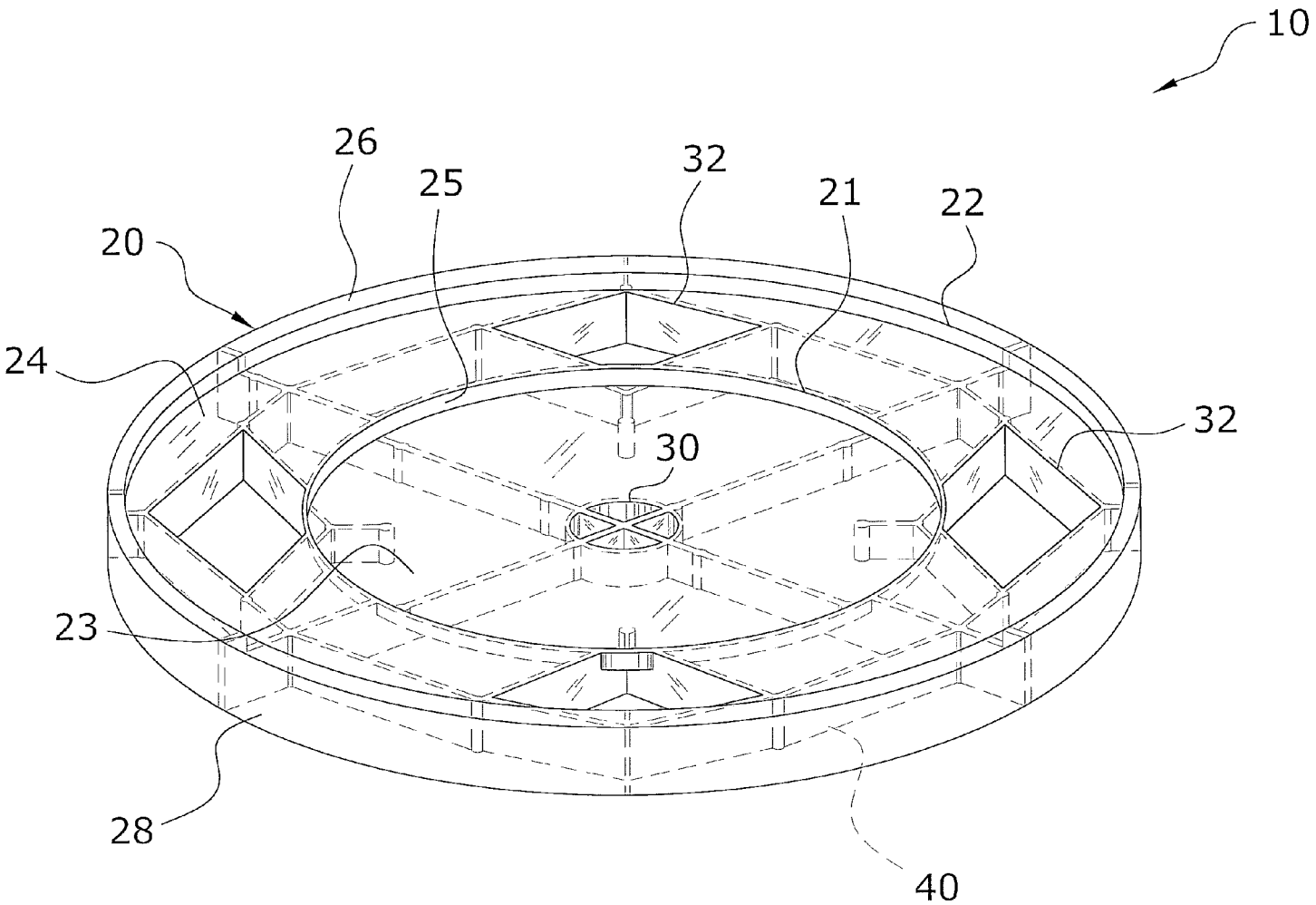
FIG. 1 is an upper perspective view of the present invention.
Figure 2:
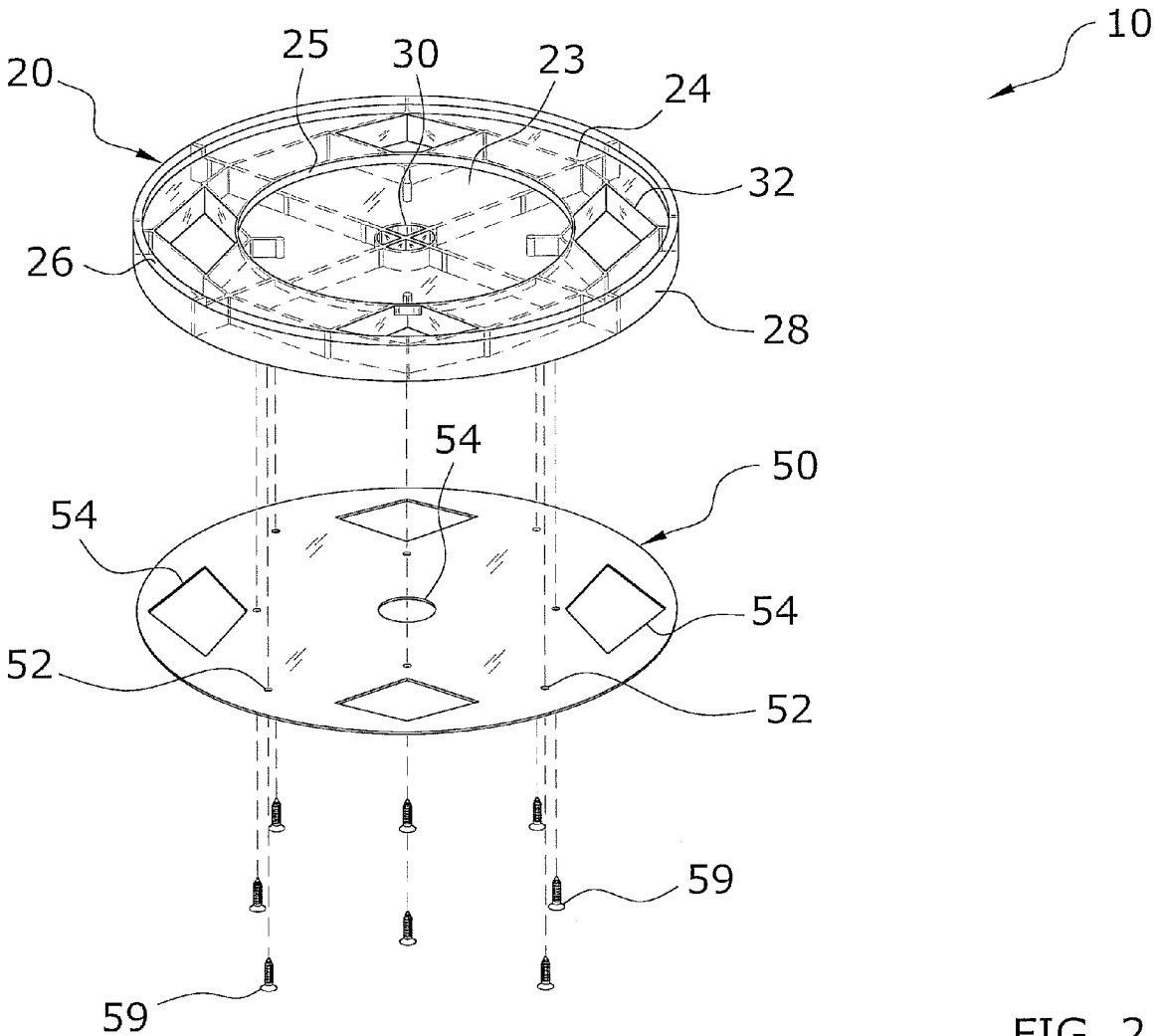
FIG. 2 is an upper perspective view of the present invention with the base exploded from the support pad.
Figure 3:
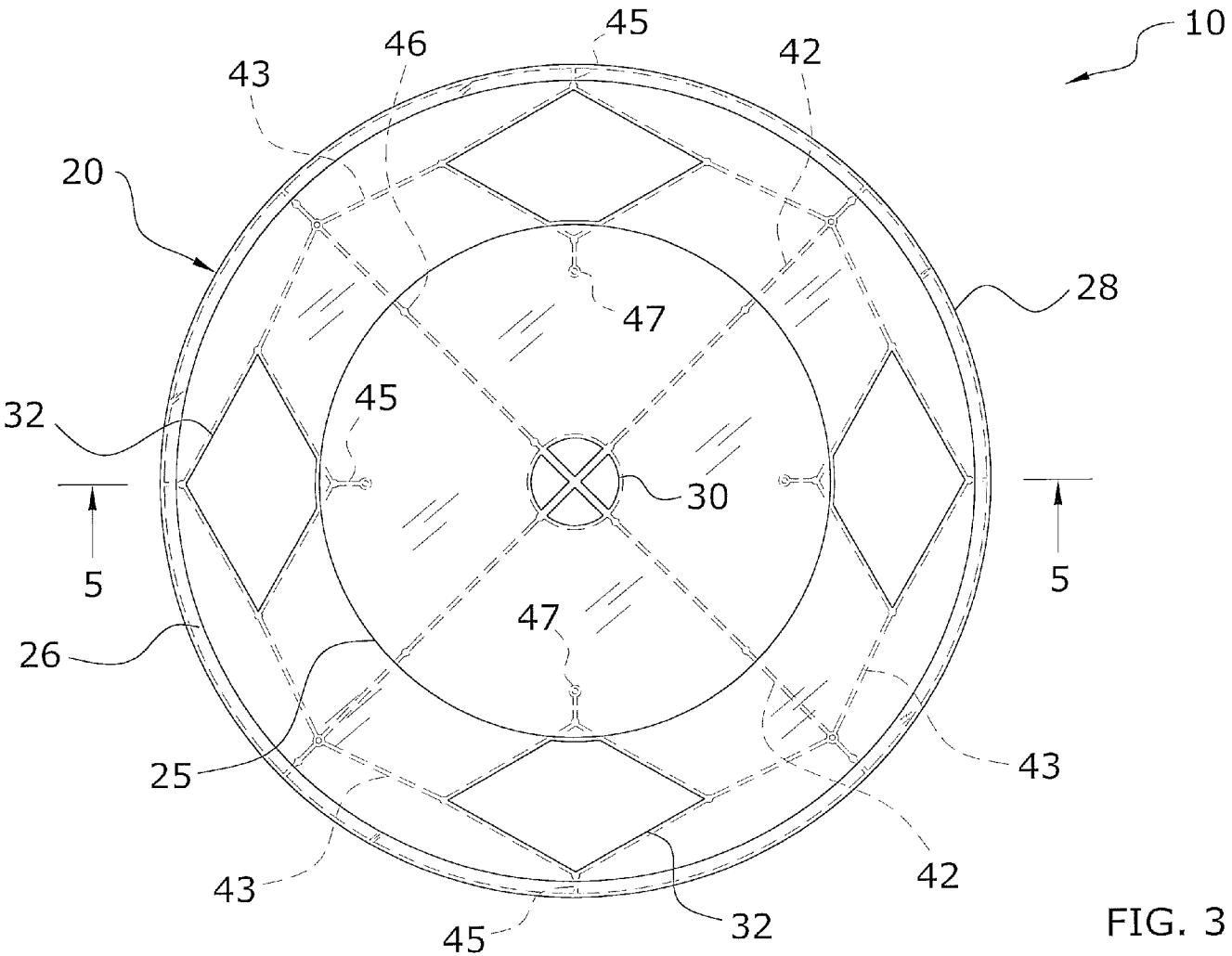
FIG. 3 is a top view of the present invention.
Figure 4:
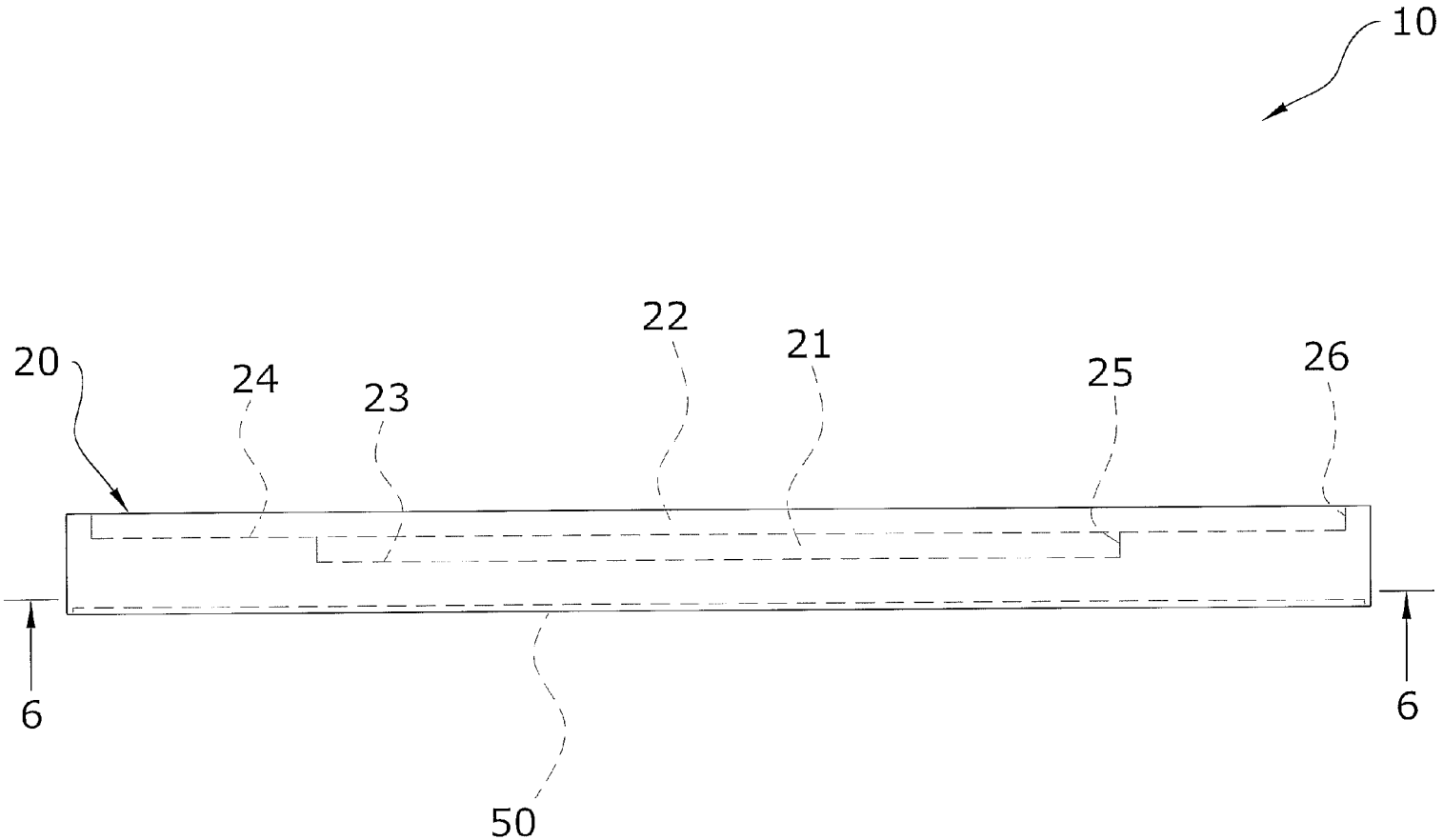
FIG. 4 is a side view of the present invention
Figure 5:
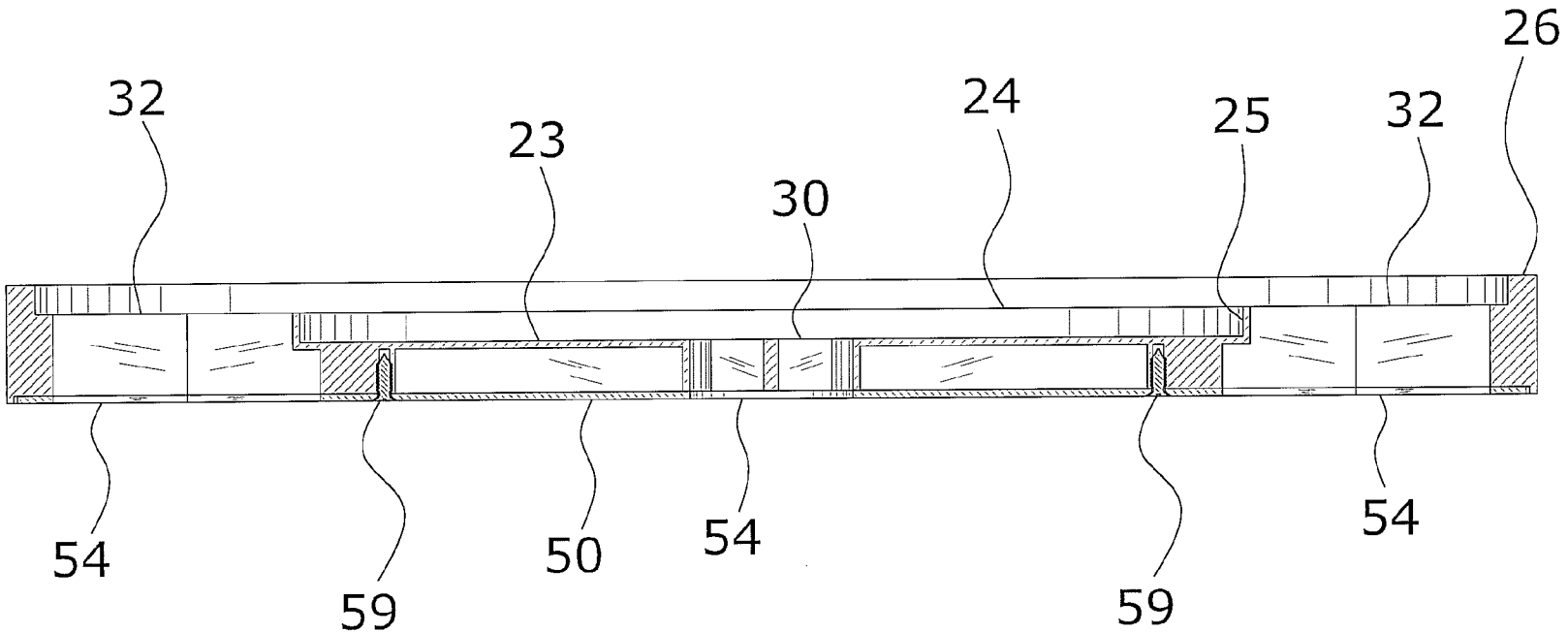
FIG. 5 is a cross-sectional view taken along lines 5-5 of FIG. 3.
Figure 6:
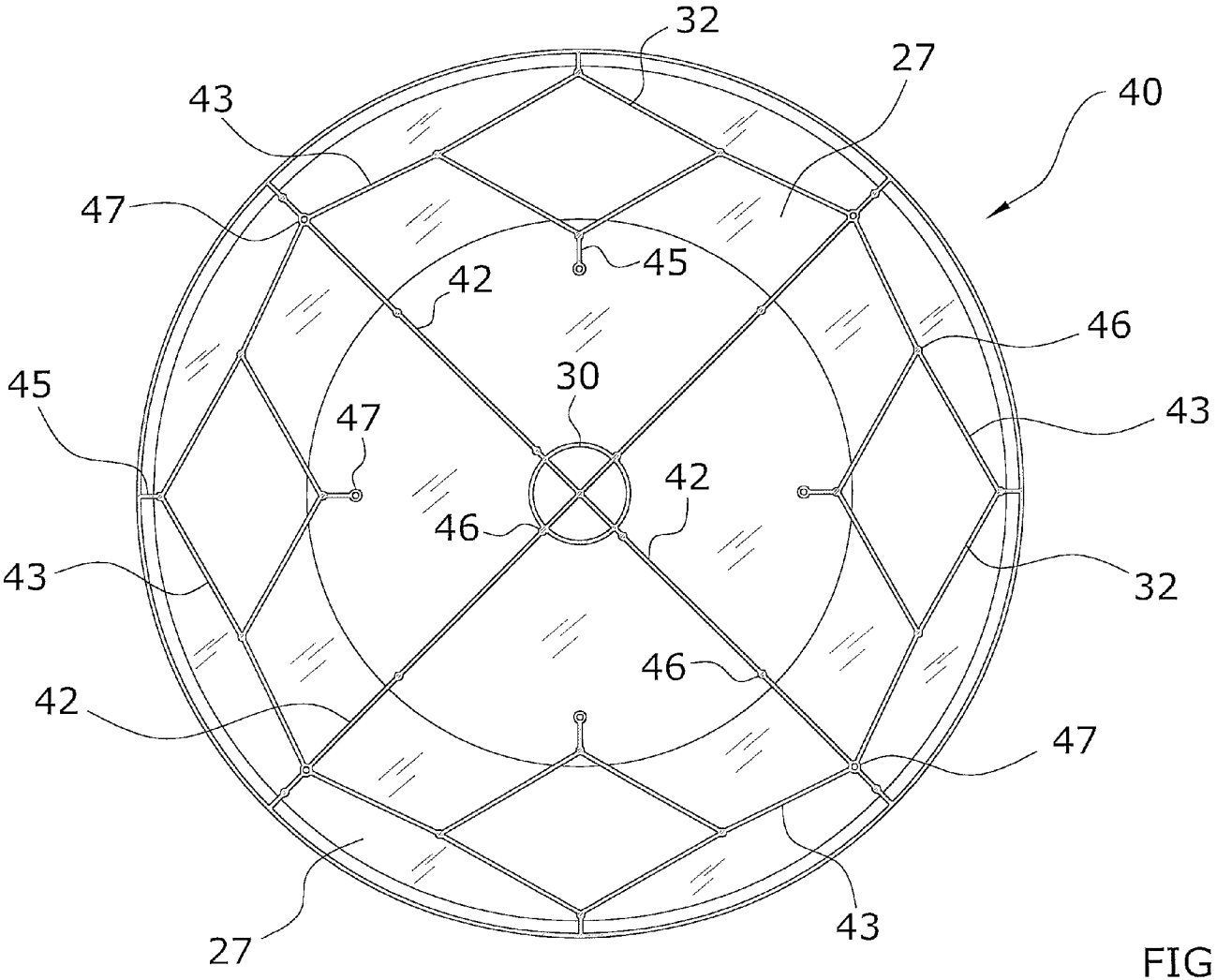
FIG. 6 is a cross-sectional view taken along lines 6-6 of FIG. 4.
Figure 7:
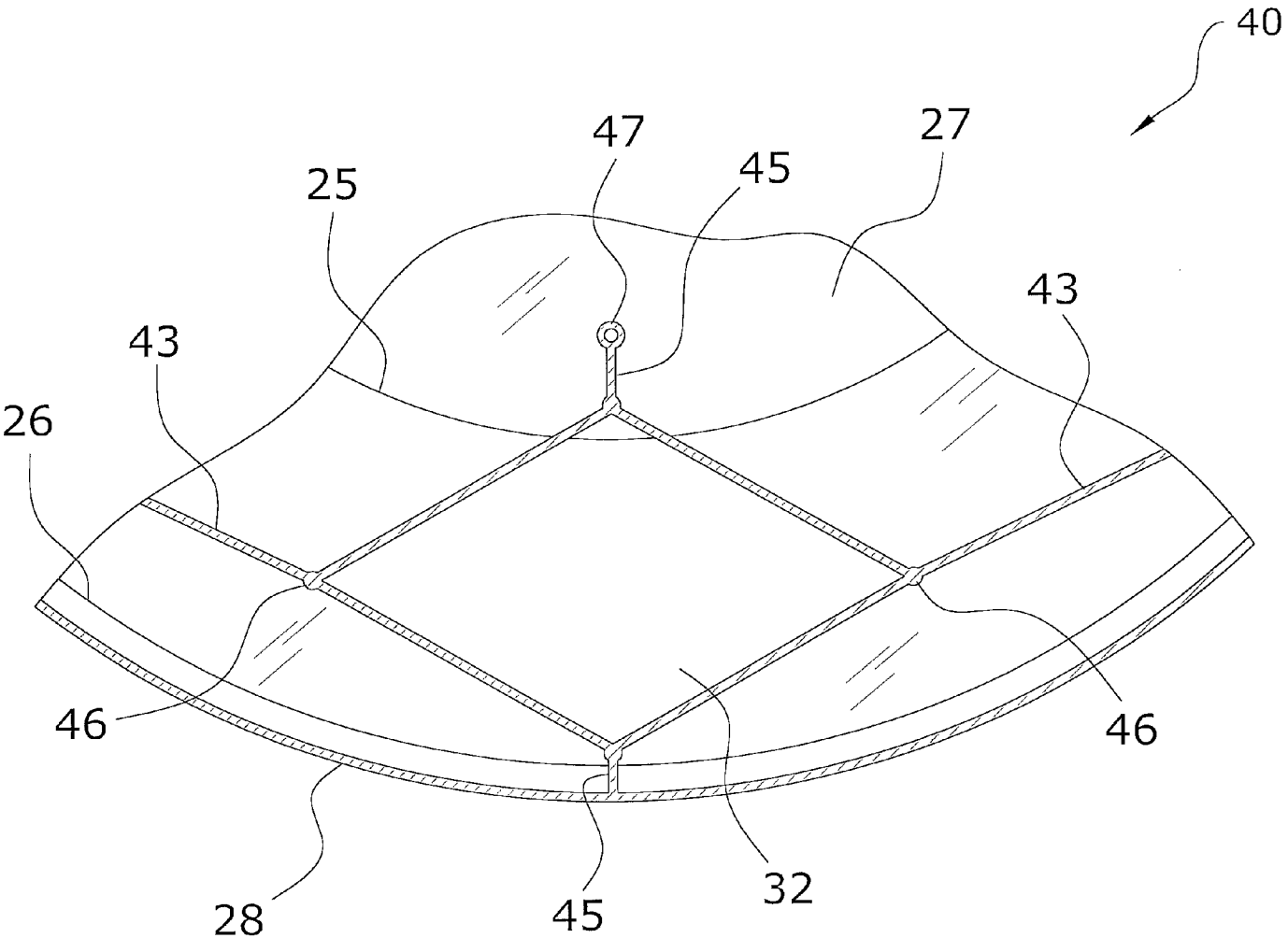
FIG. 7 is a magnified view of the internal ribbing structure and the outer drainage opening illustrated in FIG. 6.
Figure 8:
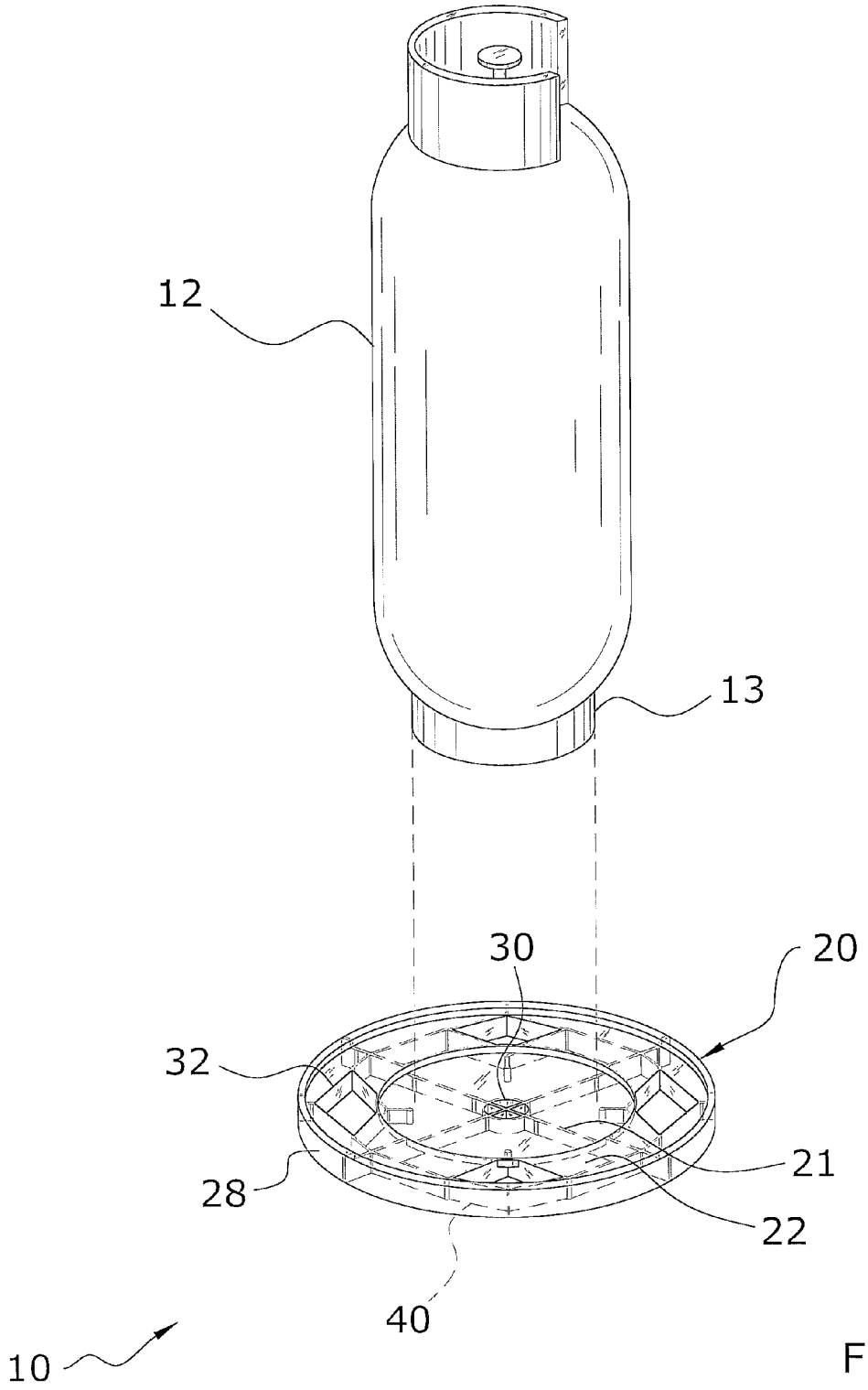
FIG. 8 is an upper perspective view of the present invention with a propane tank exploded from the present invention.

Turning now descriptively to the drawings, in which similar reference characters denote similar elements throughout the several views, FIGS. 1 through 8 illustrate a vertical fuel tank support system 10, which comprises a ribbing structure including an second ribbing portion 43, wherein the ribbing structure 40 extends beneath a platform of a support pad 20, wherein the second ribbing portion 43 interconnects with a first ribbing portion 42 and a plurality of outer drainage openings 32 of the support pad 20 and wherein the second ribbing portion 43 is aligned with an outer platform 24 of the support pad 20 to provide support to the outer platform 24. The ribbing structure provides increased support for the support pad 20 to accommodate for heavy fuel tanks 12 positioned upon the support pad 20. It is appreciated that although the present invention is described and illustrated as supporting propane tanks 12, the present invention may be utilized to support various other fuel tanks or various other structures rather than propane tanks 12.

B. Support Pad

The support pad 20 is comprised of a rigid structure to support an end of a propane tank 12. The support pad 20 is preferably positioned under a lower ring 13 of the propane tank 12, wherein the present invention is preferably utilized with vertical propane tanks 12 up to and including 420 gallon propane tanks 12. The support pad 20 is also comprised of a strong structure to support the excessive weight of the propane tank 12. The support pad 20 is further comprised of a material that is substantially weatherproof so as to be left outside at all times and not wear away or corrode.

In the preferred embodiment, the support pad 20 is comprised of a virgin plastic material and is molded to shape; however it is appreciated that the support pad 20 may be comprised of various materials and be constructed in various manners. The support pad 20 is preferably comprised of a circular configuration to match the shape of the lower ring 13 of the propane tank 12; however it is appreciated that the support pad 20 may be comprised of various shapes to accommodate various shaped propane tanks 12.

The support pad 20 is also preferably comprised of a hollow structure to allow the present invention to be substantially lightweight so that the present invention may be easily transported, wherein an internal cavity 27 extends within the support pad 20. The internal cavity 27 preferably extends throughout the inside of the support pad 20. An internal ribbing structure 40 is positioned within the internal cavity 27 to provide support for the support pad 20 when the propane tank 12 is positioned upon the support pad 20. The internal ribbing structure 40 also serves to better distribute the weight from the propane tank 12 upon the support pad 20.

C. Platform

The support pad 20 includes an outer receiver opening 22 extending towards an outer platform 24 and inner receiver opening 21 extending through the outer platform 24 and leading towards an inner platform 23. The outer receiver opening 22 and outer platform 24 are preferably concentric with the inner receiver opening 21 and the inner platform 23. The outer receiver opening 22 and outer platform 24 preferably receive larger tanks that are not able to fit within the inner receiver opening 21 and onto the inner platform 23, wherein the diameter of the outer receiver opening 22 is larger than the diameter of the inner receiver opening 21. The outer platform 24 and the inner platform 23 further preferably receive the lower ring 13 of the vertical propane tank 12.

The support pad 20 further includes at least one inner drainage opening 30 extending vertically through the inner platform 23. The inner drainage opening 30 is preferably concentric with the inner platform 23. The inner drainage opening 30 allows water from rain or melted snow to drain from the inner platform 23 onto the supporting ground surface. The inner drainage opening 30 also allows air to circulate about the lower ring 13 of the propane tank 12 to keep the lower ring 13 and lower end of the propane tank 12 dry and rust free. The inner drainage opening 30 is preferably comprised of a circular shaped configuration.

The support pad 20 further includes at least one outer drainage opening 32 extending vertically through the outer platform 24. The outer drainage opening 32 is preferably concentric with the outer platform 24. The outer drainage opening 32 allows water from rain or melted snow to drain from the outer platform 24 onto the supporting ground surface. The outer drainage opening 32 also allows air to circulate about the lower ring 13 of the propane tank 12 to keep the lower ring 13 and lower end of the propane tank 12 dry and rust free.

The support pad 20 further preferably includes a plurality of outer drainage openings 32 extending around the outer platform 24 adjacent the perimeter of the outer platform 24. The outer drainage openings 32 are preferably comprised of a diamond shaped configuration and follow the path of the perimeter of the outer platform 24. The present invention preferably includes 4 outer drainage openings 32 equidistantly spaced from one another; however it is appreciated that the present invention may include more or less outer drainage openings 32 rather than the preferred embodiment.

A first raised edge 25 is also preferably defined between the inner platform 23 and the outer platform 24 to prevent the lower ring 13 of the propane tank 12 from moving onto the outer platform 24 when positioned upon the inner platform 23. A second raised edge 26 preferably defines the outer perimeter of the outer platform 24 and the support pad 20 and preferably prevents the lower ring 13 of the propane tank 12 from sliding off of the support pad 20. The outer platform 24 is also preferably vertically elevated from the lower platform and is integral with the first raised edge 25. An outer wall 28 also preferably surrounds the support pad 20 and defines the outer perimeter of the support pad 20 below the second raised edge 26.

D. Internal Ribbing Structure

The support pad 20 includes the internal ribbing structure 40 spread throughout the internal cavity 27 of the support pad 20. The internal ribbing structure 40 is preferably comprised of an interlocking structure and preferably distributes the weight placed upon the platform so as to prevent the support pad 20 from sagging or bending at the center. The internal ribbing structure 40 is preferably molded within the internal cavity 27 and is comprised of a durable and strong material so as to withstand large amounts of weight without deforming. The internal ribbing structure 40 preferably includes a first ribbing portion 42 and a second ribbing portion 43. The second ribbing portion 43 helps to better distribute the weight towards the outer platform 24 and thus prevent the inner platform 23 and outer platform 24 from sagging or bending.

The first ribbing portion 42 preferably extends across the entire internal cavity 27 from one side to the other. The first ribbing portion 42 also preferably extends through the inner drainage opening 30 in a crossing manner. The first ribbing portion 42 is further preferably comprised of an X-shaped configuration. The first ribbing portion 42 preferably extends below both the outer platform 24 and the inner platform 23 to provide support for both the outer platform 24 and the inner platform 23.

The second ribbing portion 43 extends around the around the internal cavity 27 below the outer platform 24 adjacent the perimeter of the outer platform 24. The second ribbing portion 43 serves to provide support for the outer platform 24, wherein larger and heavier tanks are generally positioned upon the outer platform 24 and thus additional ribbing may be needed to support the outer platform 24 to prevent the platform from sagging or breaking.

The second ribbing portion 43 also interconnects with both the outer drainage openings 32 and the first ribbing portion 42 in a continuous and interlocking manner. The second ribbing portion 43 further preferably extends along a central perimeter of the outer platform 24, wherein the central perimeter is between the first raised edge 25 and the second raised edge 26.

The second ribbing portion 43 is further preferably comprised of an octagon shaped configuration; however it is appreciated that the second ribbing portion 43 may be comprised of various shapes rather than that disclosed in the preferred embodiment. The first ribbing portion 42 and the second ribbing portion 43 are connected to help transfer and distribute the weight of the propane tank 12 to different areas of the support pad 20.

The internal ribbing structure 40 also preferably includes a plurality of connecting tabs 45 to provide further support for the outer platform 24 and the inner platform 23. The connecting tabs 45 preferably connect the structure surrounding the outer drainage openings 32 to the outer wall 28 of the support pad 20 to increase support around the outer drainage openings 32. The connecting tabs 45 also preferably extend from an opposing side of the outer drainage openings 32 to connect to a mounting tab 47 extending from the inner platform 23 to increase support between the outer platform 24 and the inner platform 23.

Each intersecting rib of the internal ribbing structure 40 may also include a support 46 at the intersection of the rib. The support 46 is preferably positioned upon the bottom of the interlocking rib of the internal ribbing structure 40. The support 46 contacts the base plate 50, wherein the base plate 50 is pushed up against the supports 46 of the internal ribbing structure 40 within the internal cavity 27 when assembled. The supports 46 at the intersection of the internal ribbing structure 40 preferably increase the surface area of the intersecting ribs to better distribute the weight of the propane tank 12 upon the base plate 50. The supports 46 may be comprised of various shapes, such as but not limited to circular.

A plurality of mounting tabs 47 are also positioned at various places upon the internal ribbing structure 40, such as but not limited to the intersection of the first ribbing portion 42 and the second ribbing portion 43, integral with the connecting tabs 45 or integral with the supports 46. It is appreciated that the mounting tabs 47 may also extend inwardly from the perimeter of the internal cavity 27. The mounting tabs 47 preferably each include openings extending through to receive the fasteners 59 that are utilized to attach the base plate 50 to the support pad 20. The openings of the mounting tabs 47 thus preferably align with the apertures 52 of the base plate 50.

E. Base Plate

The present invention also includes a base plate 50 that is preferably removably attached to the support pad 20. The base plate 50 forms the bottom of the support pad 20 to prevent dirt or other material from entering within the internal cavity 27 and also to better distribute the weight of the propane tank 12 over the entire surface area of the base plate 50. The base plate 50 is preferably removable to allow for easier manufacture of the present invention and also to allow access to the internal cavity 27. It is appreciated however that the base plate 50 may be integrally formed with the support pad 20 in alternate configurations of the present invention.

The base plate 50 includes a plurality of apertures 52 extending through the base plate 50 and following a perimeter of the base plate 50. The apertures 52 preferably align with the openings of the mounting tab 47, wherein the apertures 52 and the mounting tab 47 preferably threadably receive a fastener 59 (e.g. screws) to attach the base plate 50 to the support pad 20.

It is appreciated that when attaching the base plate 50 to the support pad 20, the upper surface of the base plate 50 is positioned evenly against the first supports 46, the second supports 46 and the mounting tabs 47. The lower surface of the base plate 50 is preferably flush with the lower end of the base portion. The base plate 50 also includes a plurality of lower drainage openings 54 to interconnect with the inner drainage opening 30 and the outer drainage openings 32 of the support pad 20. The lower drainage openings 54 and the inner drainage opening 30 and outer drainage openings 32 are preferably comprised of a similar configuration and are connected in a manner so as to prevent water from seeping within the internal cavity 27 and to direct the water through the drainage openings and onto the ground surface.

F. Operation of Preferred Embodiment

In use, the present invention is first assembled by attaching the base plate 50 to the support pad 20. The lower ring 13 of the propane tank 12 is now positioned upon the desired inner platform 23 or outer platform 24 by positioning the lower ring 13 within the respective inner receiver opening 21 or outer receiver opening 22 and onto the inner platform 23 or the outer platform 24. The present invention is now able to distribute the weight of the propane tank 12 among the internal ribbing structure 40.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A vertical fuel tank support system, comprising:

a support pad including an internal cavity, wherein said internal cavity extends throughout said support pad;

an inner platform defining a first portion of an upper surface of said elongated support pad, wherein said inner platform is comprised of circular configuration;

an outer platform defining a second portion of an upper surface of said elongated support pad, wherein said outer platform is comprised of circular configuration; and an internal ribbing structure extending within said internal cavity and beneath said inner platform and said outer platform;

wherein said internal ribbing structure includes a first ribbing portion and a second ribbing portion, wherein said first ribbing portion interconnects with said second ribbing portion;

wherein said first ribbing portion extends across said inner platform and said outer platform and wherein said second ribbing portion extends solely around said outer platform;

wherein said internal ribbing structure includes a plurality of mounting holes extending through an intersection of said first ribbing portion and said second ribbing portion.

2. The vertical fuel tank support system of claim 1, wherein said second ribbing portion is concentric with said support pad.

3. The vertical fuel tank support system of claim 1, wherein said second ribbing portion interconnects with every one of a plurality of outer drainage openings of said support pad extending through said platform.

4. The vertical fuel tank support system of claim 3, wherein said second ribbing portion extends between said plurality of outer drainage openings and said first ribbing portion.

5. The vertical fuel tank support system of claim 1, wherein said second ribbing portion is comprised of an octagonal shaped configuration.

6. The vertical fuel tank support system of claim 1, wherein said second ribbing portion extends along a central perimeter of said outer platform, wherein said central perimeter is centrally between an inner and outer edge of said outer platform.

7. The vertical fuel tank support system of claim 1, including a plurality of connecting tabs extending from a plurality of outer drainage openings extending through said outer platform of said support pad.

8. The vertical fuel tank support system of claim 7, wherein said plurality of connecting tabs connect said plurality of drainage openings to an outer wall of said support pad.

9. The vertical fuel tank support system of claim 7, wherein said plurality of connecting tabs connect said plurality of drainage openings to said inner platform of said support pad.

10. The vertical fuel tank support system of claim 1, including a base plate adapted to cover a bottom of said support pad to substantially enclose said internal cavity.

11. A vertical fuel tank support system, comprising:

a support pad including an internal cavity, wherein said internal cavity extends throughout said support pad;

an inner platform defining a first portion of an upper surface of said elongated support pad, wherein said inner platform is comprised of circular configuration;

an outer platform defining a second portion of an upper surface of said elongated support pad, wherein said outer platform is comprised of circular configuration;

wherein said outer platform includes a plurality of outer drainage openings; and an internal ribbing structure extending within said internal cavity and beneath said inner platform and said outer platform;

wherein said internal ribbing structure includes a first ribbing portion and a second ribbing portion, wherein said first ribbing portion interconnects with said second ribbing portion;

wherein said first ribbing portion extends across said inner platform and said outer platform and wherein said second ribbing portion extends solely around said outer platform;

wherein said second ribbing portion interconnects with every one of said plurality of outer drainage openings of said support pad extending through said outer platform; and a plurality of connecting tabs extending from said second ribbing portion lining said plurality of outer drainage openings to an outer wall of said support pad.

12. The vertical fuel tank support system of claim 11, wherein said second ribbing portion is concentric with said support pad.

13. The vertical fuel tank support system of claim 11, wherein said second ribbing portion extends between said plurality of outer drainage openings and said first ribbing portion.

14. The vertical fuel tank support system of claim 11, wherein said second ribbing portion is comprised of an octagonal shaped configuration.

15. The vertical fuel tank support system of claim 11, wherein said second ribbing portion extends along a central perimeter of said outer platform, wherein said central perimeter is centrally between an inner and outer edge of said outer platform.

16. The vertical fuel tank support system of claim 11, wherein said plurality of connecting tabs connect said plurality of drainage openings to said inner platform of said support pad.

17. The vertical fuel tank support system of claim 11, wherein said ribbing structure includes a plurality of mounting holes extending through an intersection of said first ribbing portion and said second ribbing portion.

18. The vertical fuel tank support system of claim 11, including a base plate connected to a bottom of said support pad, wherein said base plate includes a plurality of openings to align with said plurality of outer drainage openings of said outer platform.

19. A vertical fuel tank support system, comprising:

a support pad including an internal cavity, wherein said internal cavity extends throughout said support pad;

an inner platform defining a first portion of an upper surface of said elongated support pad, wherein said inner platform is comprised of circular configuration;

an outer platform defining a second portion of an upper surface of said elongated support pad, wherein said outer platform is comprised of circular configuration;

an internal ribbing structure extending within said internal cavity and beneath said inner platform and said outer platform;

wherein said internal ribbing structure includes a first ribbing portion and a second ribbing portion, wherein said first ribbing portion interconnects with said second ribbing portion;

wherein said first ribbing portion extends across said inner platform and said outer platform and wherein said second ribbing portion extends solely around said outer platform;

wherein said second ribbing portion interconnects with every one of a plurality of outer drainage openings of said support pad extending through said platform;

wherein said second ribbing portion is concentric with said support pad;

wherein said second ribbing portion extends between said plurality of outer drainage openings and said first ribbing portion;

wherein said second ribbing portion is comprised of an octagonal shaped configuration;

wherein said second ribbing portion extends along a central perimeter of said outer platform, wherein said central perimeter is centrally between an inner and outer edge of said outer platform; and a plurality of connecting tabs extending from said plurality of outer drainage openings extending through said outer platform of said support pad;

wherein said plurality of connecting tabs connect said plurality of drainage openings to an outer wall of said support pad;

wherein said plurality of connecting tabs connect said plurality of drainage openings to said inner platform of said support pad;

wherein said ribbing structure includes a plurality of mounting holes extending through an intersection of said first ribbing portion and said second ribbing portion.

20. The vertical fuel tank support system of claim 10, including a plurality of fasteners to connect said base plate to said internal ribbing structure via extending within said plurality of mounting holes.

* * * * *